US006219875B1

(12) United States Patent
Medynski et al.

(10) Patent No.: US 6,219,875 B1
(45) Date of Patent: Apr. 24, 2001

(54) TOOTHBRUSH FOR CLEANING TEETH WITH ASSISTANCE FROM OPPOSED TEETH

(76) Inventors: Erika J. Medynski; George S. Medynski, both of 81 Warren Ave., Ho Ho Kus, NJ (US) 07423

( * ) Notice: Subject to any disclaimer, the term of this patent is extended or adjusted under 35 U.S.C. 154(b) by 0 days.

(21) Appl. No.: 09/448,265

(22) Filed: Nov. 24, 1999

(51) Int. Cl.[7] ..... A46B 9/04
(52) U.S. Cl. ..... 15/167.1; D4/104
(58) Field of Search ..... 15/167.1; D4/104

(56) References Cited

U.S. PATENT DOCUMENTS

| | | | | |
|---|---|---|---|---|
| D. 140,438 | * | 2/1945 | Cohen | D4/104 |
| D. 165,248 | * | 11/1951 | Sherrod et al. | D4/104 |
| D. 179,441 | | 12/1956 | Clemens | D4/104 |
| D. 287,072 | | 12/1986 | Pfleger | D4/104 |
| 2,305,461 | | 12/1942 | Spyra | 15/167.1 |
| 2,934,776 | * | 5/1960 | Clemens | 15/167.1 |
| 3,087,223 | | 4/1963 | Raw | 26/27 |
| 3,103,679 | * | 9/1963 | Clemens | 15/167.1 |
| 3,258,805 | | 7/1966 | Rossnan | 15/110 |
| 4,010,509 | * | 3/1977 | Huish | 15/167.1 |
| 4,115,894 | | 9/1978 | Peterson | 15/167.1 |
| 4,167,794 | | 9/1979 | Pomeroy | 15/188 |
| 4,382,309 | | 5/1983 | Collis | 15/167.2 |
| 4,493,125 | | 1/1985 | Collis | 15/167.2 |
| 4,504,998 | | 3/1985 | Price et al. | 15/186 |
| 4,776,055 | | 10/1988 | Nelson | 15/167.1 |
| 5,622,502 | * | 4/1997 | Wilkes et al. | 15/167.1 X |

* cited by examiner

*Primary Examiner*—Mark Spisich
(74) *Attorney, Agent, or Firm*—Arthur Jacob

(57) ABSTRACT

A toothbrush for cleaning selected teeth does so with the aid of teeth opposed to the selected teeth and includes groups of bristles extending altitudinally from an upper face of a bristle support and bowed to curve laterally outwardly in directions away from one another, the bristle support including a concave support surface on a lower face of the bristle support for engaging the opposed teeth and guiding the bristle support through rocking motions which enable bristles in the groups of bristles to sweep over the selected teeth and effect cleaning of the selected teeth, and between adjacent teeth, while also messaging the gum adjacent the selected tooth. Further support surfaces on the bristle support are spaced transversely from the upper face and guide the bristle support during further cleaning and messaging manipulations.

12 Claims, 4 Drawing Sheets

TOOTHBRUSH FOR CLEANING TEETH WITH ASSISTANCE FROM OPPOSED TEETH

The present invention relates generally to implements for use in the practice of oral hygiene and pertains, more specifically, to a toothbrush for cleaning selected teeth with assistance provided by engagement of the toothbrush with further teeth opposed to the selected teeth.

In the pursuit of more effective oral hygiene practices, toothbrushes have undergone a great deal of development toward attaining increased effectiveness with ease of use. The present invention provides a toothbrush which enables such increased effectiveness, with ease of use. As such, the present invention attains several objects and advantages, some of which are summarized as follows: Provides a toothbrush having bristles configured and arranged for effective cleaning of teeth with the assistance of engagement of the toothbrush with teeth opposed to the teeth being cleaned; provides a toothbrush bristle configuration and arrangement combined with a contoured toothbrush surface configuration for enabling cleaning of selected teeth with the assistance of teeth opposed to the selected teeth; enables ease in cleaning surfaces of the teeth, while attaining more effective cleaning between teeth and adjacent the gum line, where the teeth meet the gums; effects advantageous gum massage, as well as tooth cleaning, through manipulations assisted by opposing teeth; provides a toothbrush which enables more effective oral hygiene practice without a vast departure from conventional practices which utilize a toothbrush, thereby encouraging widespread use; provides a toothbrush capable of being manufactured and sold at costs comparable to current conventional toothbrushes, while providing features far advanced over conventional toothbrushes.

The above objects and advantages, as well as further objects and advantages, are attained by the present invention which may be described briefly as a toothbrush for cleaning selected teeth while being assisted by corresponding opposed teeth in effecting cleaning manipulations, the toothbrush comprising: a manipulating member extending longitudinally between first and second ends; a handle adjacent the first end; a bristle support adjacent the second end; and a multiplicity of bristles extending altitudinally from the bristle support, the bristles being arranged in groups of bristles within a field of bristles having laterally opposite first and second edges, each bristle having a proximal end at the bristle support and a distal end remote from the bristle support, the field including at least a first group of bristles extending longitudinally adjacent the first edge of the field, and a second group of bristles extending longitudinally adjacent the second edge of the field; the bristles of the first group being curved between the proximal end and the distal end of each bristle to curve laterally away from the bristles of the second group; the bristles of the second group being bowed between the proximal end and the distal end of each bristle to curve laterally away from the bristles of the first group; and the bristle support having at least one support surface spaced transverse from the first and second groups of bristles, the support surface having a curved transverse cross-sectional configuration for engaging the opposed teeth while the toothbrush is manipulated for cleaning the selected teeth with the first and second groups of bristles, whereby the engagement of the curved support surface with the opposing teeth assists in creating cleaning manipulations in which the bristles of the first and second groups clean the selected teeth.

The invention will be understood more fully, while still further objects and advantages will become apparent, in the following detailed description of a preferred embodiment of the invention illustrated in the accompanying drawing, in which.

Figure 1:
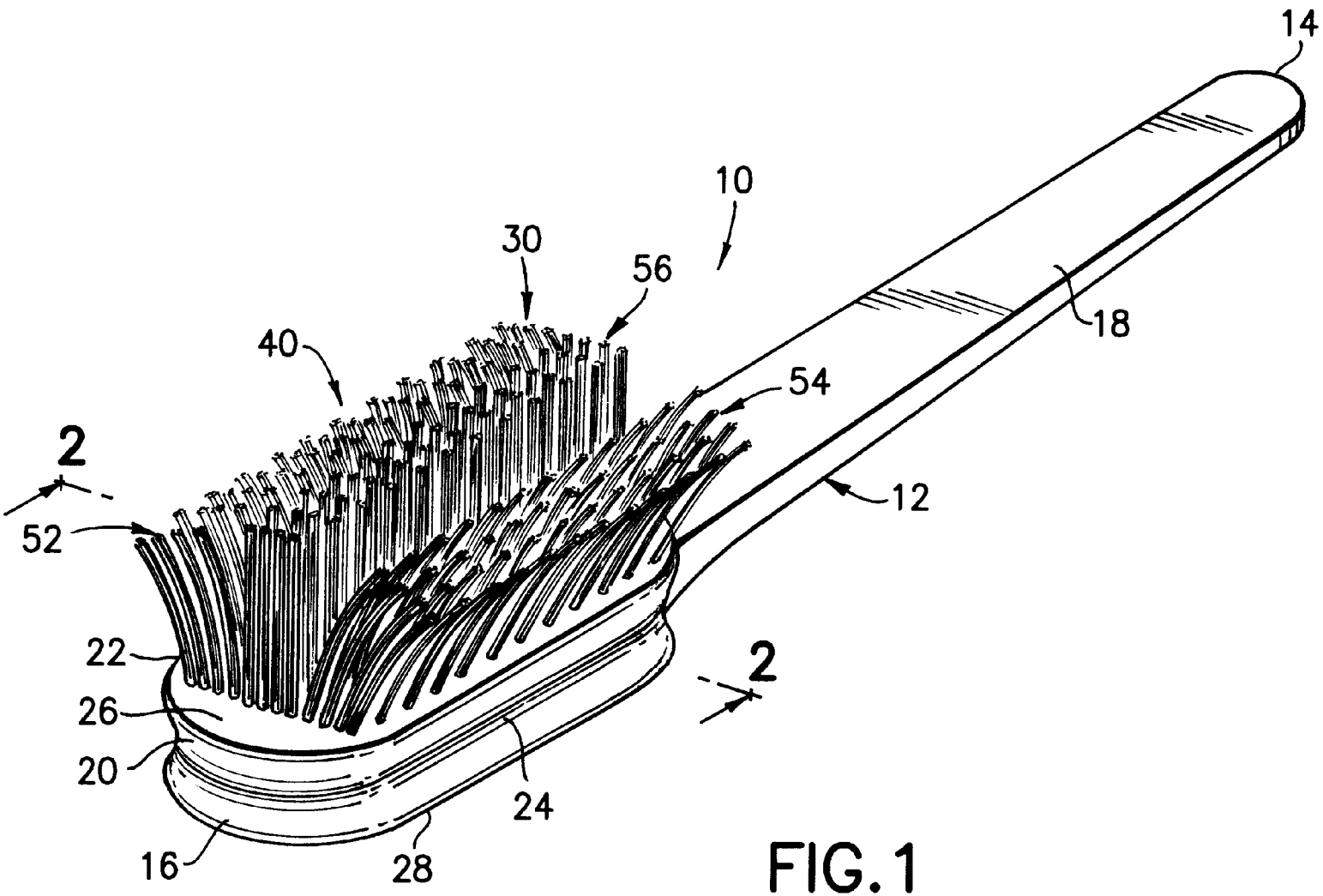
FIG. 1 is a pictorial perspective view of a toothbrush constructed in accordance with the present invention.

Referring now to the drawing, and especially to FIG. 1 thereof, a toothbrush constructed in accordance with the present invention is shown at 10 and is seen to include a manipulating member 12 extending longitudinally from a first end 14 to a second end 16. A handle 18 is located adjacent the first end 14 and is unitary with the manipulating member 12, in a now conventional manner. A bristle support 20 is located adjacent the second end 16, as a unitary portion of the manipulating member 12.

Figure 2:
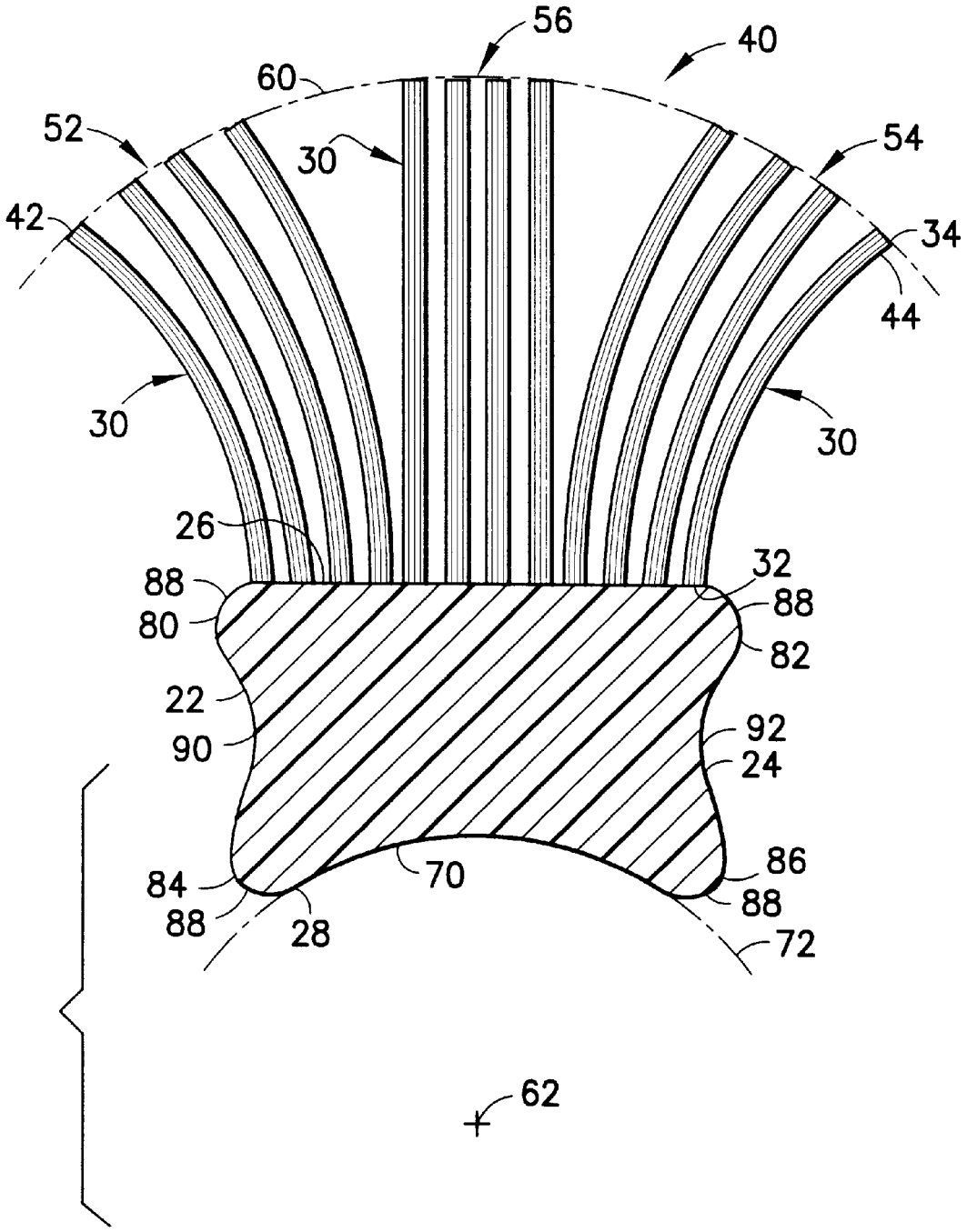
FIG. 2 is an enlarged transverse cross-sectional view taken along line 2—2 of FIG. 1.
Figure 3:
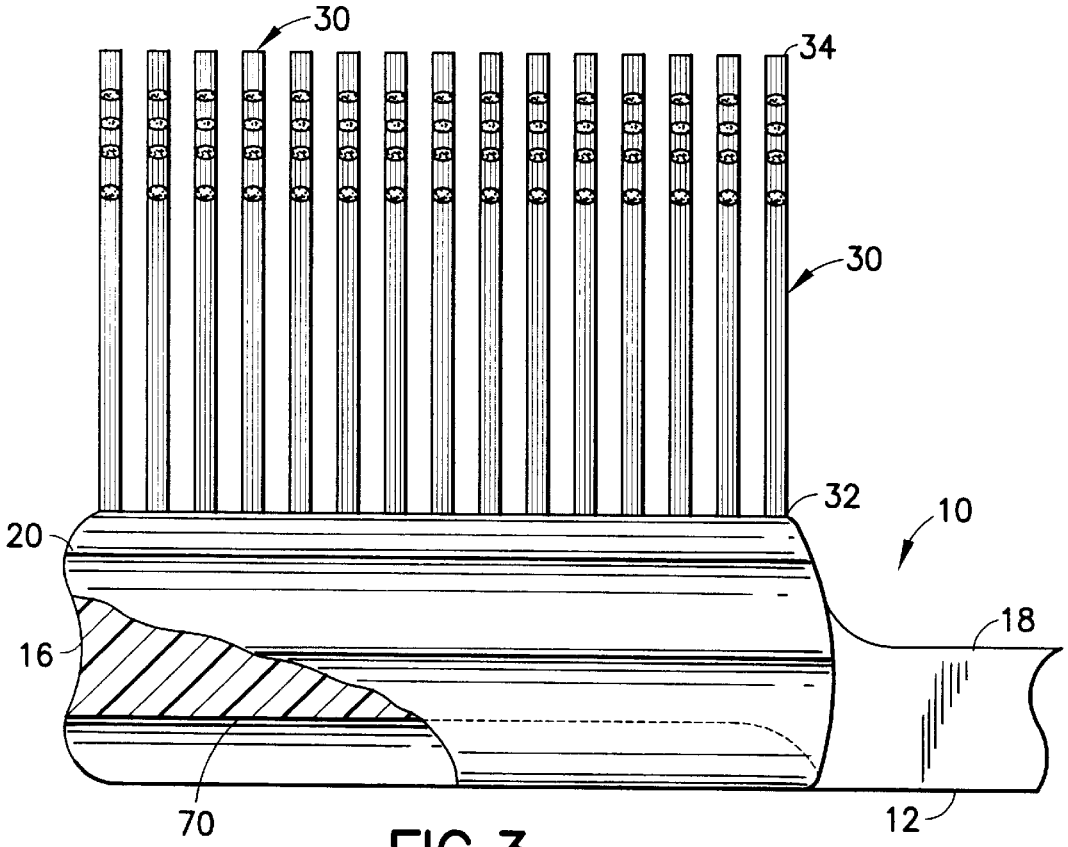
FIG. 3 is a fragmentary side elevational view, partially sectioned, of a portion of the toothbrush.

As best seen in FIGS. 2 and 3, as well as in FIG. 1, the bristle support 20 includes longitudinally extending opposite first and second sides 22 and 24, and altitudinally opposite first and second faces 26 and 28. A multiplicity of bristles 30 extend altitudinally from the first, or upper, face 26 of the bristle support 20, each bristle 30 having a proximal end 32 at the bristle support 20 and a distal end 34 remote from the bristle support 20. Bristles 30 are arranged in groups within a field 40 of bristles 30. The field 40 extends longitudinally along the length of the bristle support 20 and includes laterally opposite first and second edges 42 and 44 located adjacent corresponding opposite first and second sides 22 and 24 of the bristle support 20. A first group 52 of bristles 30 extends longitudinally along the bristle support 20 adjacent the first edge 42 of the field 40, and a second group 54 of bristles 30 extends longitudinally along the bristle support 20 adjacent the second edge 44 of the field 40. A third group 56 of bristles 30 extends longitudinally along the bristle support 20 between the first and second groups 52 and 54.

The bristles 30 of the first group 52 are bowed from the proximal end 32 toward the distal end 34 so as to curve in a laterally outward direction, away from the second and third groups 54 and 56. Likewise, the bristles 30 of the second group 54 are bowed so as to curve laterally outwardly from the proximal end 32 toward the distal end 34, in the direction away from the first and third groups 52 and 56. The bristles 30 of the third group 56 are essentially straight between the proximal end 32 and the distal end 34. In the illustrated construction, the distal ends 34 of each group 52 and 54 lie on an arc, illustrated at 60, while the distal ends 34 of the bristles 30 of group 56 extend altitudinally upwardly no further than arc 60. Preferably, essentially all of the bristles 30 in the groups 52, 54 and 56 are located on or near arc 60 such that arc 60 is essentially common to the ends 34 of the bristles 30 of all of the groups 52, 54 and 56. Arc 60 preferably is a segment of a circle having a center 62.

The bristle support 20 includes a support surface 70 extending along the lower face 28 of the bristle support 20, spaced transverse from the upper face 26, and from the bristles 30 of the three groups 52, 54 and 56. Support surface 70 has a curved transverse cross-sectional configuration, as viewed in FIG. 2, and extends longitudinally along the length of the bristle support 20, as seen in FIG. 3. The curved configuration of support surface 70 is concave, for purposes to be described more fully below, and preferably follows a circular arc 72. In the preferred construction, arc 72 lies on a circle centered at center 62. Bristle support 20 preferably includes further support surfaces. Thus, further support surfaces 80, 82, 84 and 86 are located at corners 88 of the transverse cross-sectional configuration of the bristle support 20, each spaced transversely from the groups 52, 54 and 56 of bristles 30 and extending longitudinally along the length of the bristle support 20. The further support surfaces 80, 82, 84 and 86 each have a convex curved transverse cross-sectional configuration, for purposes to be described below. Additional support surfaces 90 and 92 have a concave curved cross-sectional configuration and are located between support surfaces 80 and 84, and 82 and 86, respectively, along the length of the bristle support 20.

Figure 4:
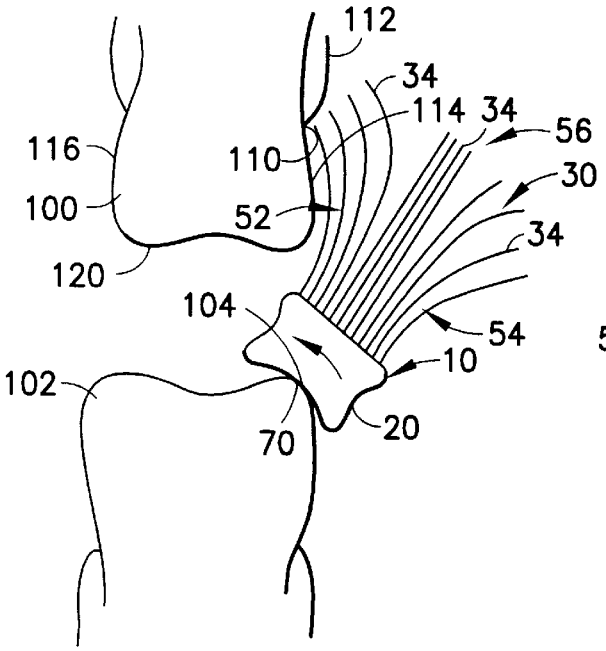
FIG. 4 is a diagrammatic end view showing the toothbrush in position and being manipulated for cleaning a selected tooth, with the assistance of an opposed tooth.
Figure 5:
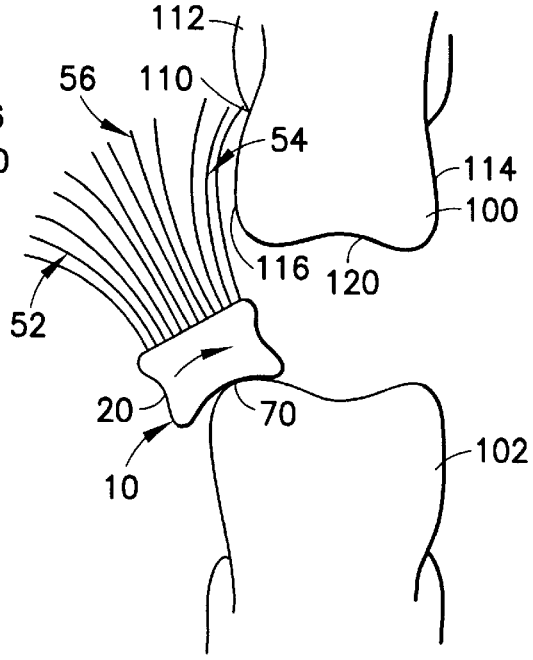
FIG. 5 is a diagrammatic end view similar to FIG. 4 and showing another position during manipulation of the toothbrush for cleaning.
Figure 6:
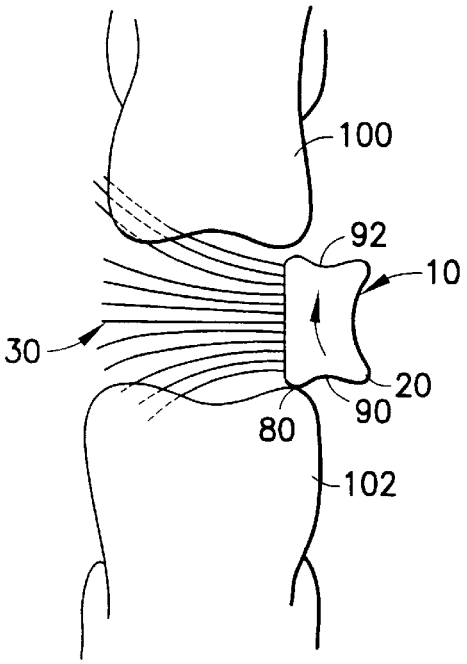
FIGS. 6 through 9 are similar diagrammatic views illustrating further manipulations of the toothbrush available during cleaning.
Figure 7:
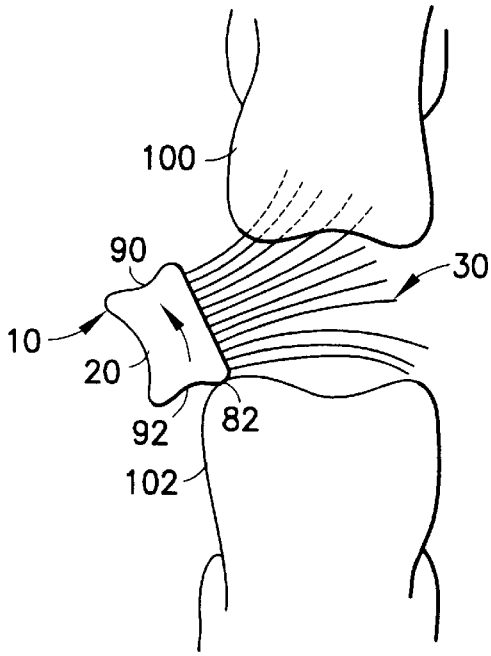
Figure 8:
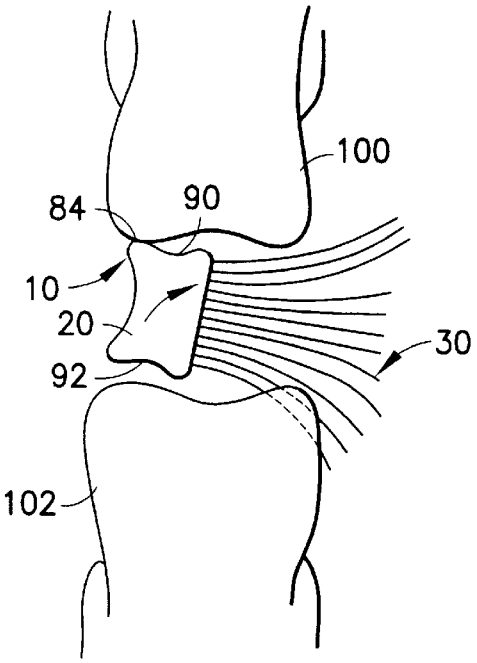
Figure 9:
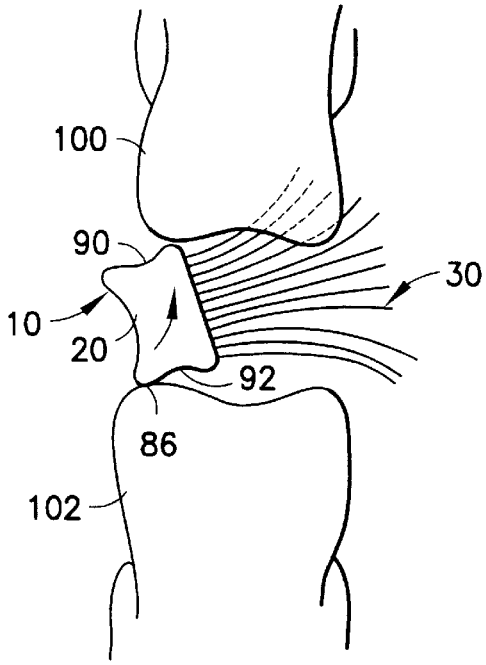

Turning now to FIGS. 4 and 5, toothbrush 10 is shown being manipulated for cleaning a selected upper tooth 100, with the assistance of a corresponding opposed lower tooth 102. Cleaning is accomplished by supporting the bristle support 20 upon the opposed tooth 102, with the support surface 70 placed against the crown 104 of the tooth 102, and then rocking the toothbrush 10 to move the support surface 70 laterally along the crown 104 of tooth 102. Lateral rocking movement of the bristle support 20, guided by the concave configuration of the support surface 70 as the support surface 70 traverses the crown 104, sweeps the distal ends 34 of the bristles 30 along the tooth 100 and between tooth 100 and adjacent teeth for effective cleaning. At the same time, the distal ends 34 move across the gum line 110, between the gum 112 and the tooth 100, to effect cleaning at and adjacent to the gum line 110 and massage of the gum 112. The outwardly bowed configuration of the bristles 30 of the first group 52 acts in concert with the resilient nature of the bristles 30 to urge the distal ends 34 against the surface 114 of tooth 100, to urge the distal ends 34 between tooth 100 and adjacent teeth, and to push the distal ends 34 beneath the gum 112 adjacent the gum line 110, assuring that the cleaning along the surface 114 of tooth 100, and between tooth 100 and adjacent teeth, is thorough and that the massage is effective. Likewise, the outwardly bowed configuration of the bristles 30 of the second group 54 assures thorough cleaning of the surface 116 of tooth 100, and adjacent corresponding gum line 110, as well as cleaning between teeth and providing an effective massage of the gum 112. The bristles 30 of the third group 56 sweep along the crown 120 of tooth 100 for effective cleaning of all of the surfaces of tooth 100, as assisted by engagement of the bristle support 20 with the opposed tooth 102.

As seen in FIGS. 6 through 9, engagement of the further support surfaces 80, 82, 84 and 86 with one or the other of teeth 100 and 102, and subsequent rocking of the bristle support 20 will effect further manipulations for cleaning of a selected tooth 100 or 102 with the assistance of the respective opposed tooth 102 or 100. Still further assistance in attaining the desired rocking motion for effective cleaning, as well as massage, is provided by the further support surfaces 90 and 92, as the bristle support 20 is moved through the motions illustrated in FIGS. 6 through 9.

As demonstrated above, the outwardly bowed configuration of the bristles 30 in the groups 52 and 54, together with at least the curved support surface 70 enable cleaning of a selected tooth with the assistance of a corresponding opposed tooth with ease and effectiveness. In addition, effective cleaning at and adjacent to the gum line is accomplished, along with desirable massage of the gum. The further support surfaces 80, 82, 84 and 86, along with additional support surfaces 90 and 92, assist further in the cleaning and massage manipulations.

It will be seen that the present invention attains the several objects and advantages summarized above, namely: Provides a toothbrush having bristles configured and arranged for effective cleaning of teeth with the assistance of engagement of the toothbrush with teeth opposed to the teeth being cleaned; provides a toothbrush bristle configuration and arrangement combined with a contoured toothbrush surface configuration for enabling cleaning of selected teeth with the assistance of teeth opposed to the selected teeth; enables ease in cleaning surfaces of the teeth, while attaining more effective cleaning between teeth and adjacent the gum line, where the teeth meet the gums; effects advantageous gum massage, as well as tooth cleaning, through manipulations assisted by opposing teeth; provides a toothbrush which enables more effective oral hygiene practice without a vast departure from conventional practices which utilize a toothbrush, thereby encouraging widespread use; provides a toothbrush capable of being manufactured and sold at costs comparable to current conventional toothbrushes, while providing features far advanced over conventional toothbrushes.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A toothbrush for cleaning selected teeth while being assisted by corresponding opposed teeth in effecting cleaning manipulations, the toothbrush comprising:

a manipulating member extending longitudinally between first and second ends;

a handle adjacent the first end;

a bristle support adjacent the second end; and a multiplicity of bristles extending altitudinally from the bristle support, the bristles being arranged in groups of bristles within a field of bristles having laterally opposite first and second edges, each bristle having a proximal end at the bristle support and a distal end remote from the bristle support, the field including at least a first group of bristles extending longitudinally adjacent the first edge of the field, and a second group of bristles extending longitudinally adjacent the second edge of the field;

the bristles of the first group being bowed between the proximal end and the distal end of each bristle to curve laterally away from the bristles of the second group;

the bristles of the second group being bowed between the proximal end and the distal end of each bristle to curve laterally away from the bristles of the first group; and the bristle support having at least one support surface spaced transverse from the first and second groups of bristles, the support surface having a curved transverse cross-sectional configuration for engaging the opposed teeth while the toothbrush is manipulated for cleaning the selected teeth with the first and second groups of bristles, whereby the engagement of the curved support surface with the opposing teeth assists in creating cleaning manipulations in which the bristles of the first and second groups clean the selected teeth.

2. The invention of claim 1 wherein the field includes a third group of bristles extending longitudinally along the bristle support between the first and second groups of bristles, the bristles of the third group being essentially straight between the proximal and distal ends of each bristle and extending altitudinally between the bristles of the first and second groups.

3. The invention of claim 2 wherein the distal ends of the bristles of both the first and second groups are located on a common arc, and the bristles of the third group extend altitudinally no further than the common arc.

4. The invention of claim 1 wherein the distal ends of the bristles of each of the first and second groups are located on an arc.

5. The invention of claim 1 wherein the distal ends of the bristles of both the first and second groups are located on a common arc.

6. The invention of claim 1 wherein the bristle support includes a first face, and a second face altitudinally opposite the first face, the field of bristles is located along the first face of the bristle support, and the one support surface is located along the second face of the bristle support.

7. The invention of claim 6 wherein the curved transverse cross-sectional configuration comprises a concave curved configuration.

8. The invention of claim 7 wherein the distal ends of the bristles of each of the first and second groups of bristles are located on a first arc, and the concave curved configuration of the one support surface is located on a second arc.

9. The invention of claim 8 wherein the first and second arcs have a common center.

10. The invention of claim 7 wherein the concave curved configuration extends longitudinally throughout the longitudinal extent of the field of bristles.

11. The invention of claim 6 including further support surfaces spaced transversely from the first and second groups of bristles, at least some of the further support surfaces having a convex curved transverse cross-sectional configuration.

12. The invention of claim 11 wherein the bristle support includes a transverse cross-sectional configuration having corners, and at least some of the further support surfaces are located at corners of the transverse cross-sectional configuration of the bristle support.

* * * * *